US008821007B2

(12) United States Patent
Stranczl et al.

(10) Patent No.: US 8,821,007 B2
(45) Date of Patent: Sep. 2, 2014

(54) TIMEPIECE BALANCE SPRING

(71) Applicant: Nivarox-FAR S.A., Le Locle (CH)

(72) Inventors: Marc Stranczl, Nyon (CH); Marco Verardo, Les Bois (CH)

(73) Assignee: Nivarox-FAR S.A., Le Locle (CH)

( * ) Notice: Subject to any disclaimer, the term of this patent is extended or adjusted under 35 U.S.C. 154(b) by 0 days.

(21) Appl. No.: 13/948,626

(22) Filed: Jul. 23, 2013

(65) Prior Publication Data

US 2014/0029390 A1 Jan. 30, 2014

(30) Foreign Application Priority Data

Jul. 26, 2012 (EP) ..... 12178081

(51) Int. Cl.
*G04B 17/04* (2006.01)

(52) U.S. Cl.
USPC ..... 368/176

(58) Field of Classification Search
USPC ..... 368/175–178, 128–133, 140, 144, 160, 368/166; 267/166; 29/896.3–896.34
See application file for complete search history.

(56) References Cited

U.S. PATENT DOCUMENTS

| | | | | |
|---|---|---|---|---|
| 3,696,687 | A | 10/1972 | Harland | |
| 3,934,403 | A * | 1/1976 | Tilse | 368/175 |
| 8,425,110 | B2 * | 4/2013 | Zaugg et al. | 368/177 |
| 8,480,294 | B2 * | 7/2013 | Helfer et al. | 368/175 |
| 2012/0075963 | A1 | 3/2012 | Zaugg | |

FOREIGN PATENT DOCUMENTS

EP 2 434 353 A1 3/2012

OTHER PUBLICATIONS

European Search Report issued Feb. 7, 2013, in European Application No. 12 17 8081 filed Jul. 26, 2012 (with English Translation).

* cited by examiner

*Primary Examiner* — Edwin A. Leon
(74) *Attorney, Agent, or Firm* — Oblon, Spivak, McClelland, Maier & Neustadt, L.L.P.

(57) ABSTRACT

A balance spring with two pairs each formed of adjacent coils respectively including a stopping device and a complementary stopping device defining together, for each pair, a respective, relative, maximum angular travel of the coils during the local coupling thereof. The stopping device and the complementary stopping device define different maximum angular travel values, to gradually limit the amplitude of pivoting between the ends of the balance spring during accelerations greater than desired values, one of the pairs cooperating in abutment before the other, to gradually modify the resulting rigidity of the balance spring by the successive deactivation or reactivation of the coils thereof.

8 Claims, 2 Drawing Sheets

TIMEPIECE BALANCE SPRING

This application claims priority from European Patent Application No. 12178081.1 filed Jul. 26, 2012, the entire disclosure of which is incorporated herein by reference.

FIELD OF THE INVENTION

The invention concerns an anti-trip balance spring for a timepiece comprising at least one strand wound between a first end and a second end and comprising at least two pairs of coils each formed of a first coil and a second coil immediately adjacent to each other, respectively comprising an stopping means and a complementary stopping means, quincuncial staggered with respect to each other, and together defining, for each of said pairs, a respective maximum angular travel during the local coupling of said first coil and said second coil resulting from said stopping means cooperating in abutment with said complementary stopping means in the event of accelerations in the contraction or extension of said balance spring which are greater than desired values, in order to limit the number of active coils of said balance spring.

The invention also concerns a timepiece sprung balance comprising at least one balance spring of this type and comprising a balance which pivots about an axis and to which said first or second end of said balance spring is fixed.

The invention also concerns a timepiece movement including at least one sprung balance of this type and a plate carrying a balance spring stud for pinning up one of the ends of said balance spring.

The invention also concerns a timepiece including at least one movement of this type, and/or at least one sprung balance of this type.

The invention concerns the field of timepiece mechanisms, and more specifically regulating members for watches

BACKGROUND OF THE INVENTION

In mechanical watches, regulating members, in particular escapements have to satisfy several "safety" criteria. One of the safety devices, the anti-trip system, is designed to prevent the angular extension of the balance beyond a normal angle of rotation.

The technical problem is to devise a safety mechanism, particularly an anti-trip system, which limits the angle of pivoting of a balance during excessive accelerations, in particular in the event of shocks, notably for a detent escapement. The anti-trip mechanism must be capable of acting in both directions of pivoting of the balance, i.e. both during extension and contraction of the balance spring.

One solution consists in changing the geometry of the balance spring by causing the lugs of consecutive coils to cooperate in abutment, so as to render some coils inactive and thus to modify the rigidity of the balance spring and its response to impulses. A mechanism of this type, capable of limiting the angular travel of the balance in both directions of pivoting is known from EP Patent No 2 434 353 A1 in the name of Montres Breguet SA, which discloses an anti-trip balance spring wherein notches pertaining to consecutive coils cooperate with each other, both during the contraction and the expansion of the balance spring. The manoeuvre is efficient, however the torque pick up remains relatively abrupt.

It is an object of the present invention to improve safety, while only very slightly disturbing the inertia of the balance, by limiting the angular travel of the balance in both directions of rotation, and gradually picking up torque.

SUMMARY OF THE INVENTION

The invention therefore concerns an anti-trip balance spring for a timepiece comprising at least one strand wound between a first end and a second end and comprising at least two pairs of coils each formed of a first coil and a second coil immediately adjacent to each other, respectively comprising an stopping means and a complementary stopping means, quincuncial staggered with respect to each other, and together defining, for each of said pairs, a respective maximum angular travel, during local coupling of said first coil and said second coil resulting from said stopping means cooperating in abutment with said complementary stopping means in the event of accelerations in the contraction or extension of said balance spring which are greater than desired values, in order to limit the number of active coils of said balance spring, characterized in that, in at least two of said pairs of coils said respective stopping means and complementary stopping means are disposed so as to define different maximum angular travel values, to gradually limit the amplitude of pivoting between said first and second ends of said balance spring during angular or radial accelerations of said balance spring which are greater than said desired values, so as to cause said stopping means and complementary stopping means of one of said pairs to cooperate in abutment before those of the other pair, and thus to gradually modify the resulting rigidity of said balance spring, by successively deactivating or reactivating some of said coils.

The invention also concerns a sprung balance for a timepiece, comprising at least one balance spring of this type, and comprising a balance which pivots about an axis and to which said first or second end of said balance spring is fixed, characterised in that the amplitude of pivoting of said balance is less than 360°.

The invention also concerns a timepiece movement including at least one sprung balance of this type and a plate carrying a balance spring stud for pinning up one of the ends of said balance spring.

The invention also concerns a timepiece including at least one movement of this type, and/or at least one sprung balance of this type.

BRIEF DESCRIPTION OF THE DRAWINGS

Other features and advantages of the invention will appear upon reading the following detailed description, with reference to the annexed drawings, in which.

DETAILED DESCRIPTION OF PREFERRED EMBODIMENTS

Figure 1:
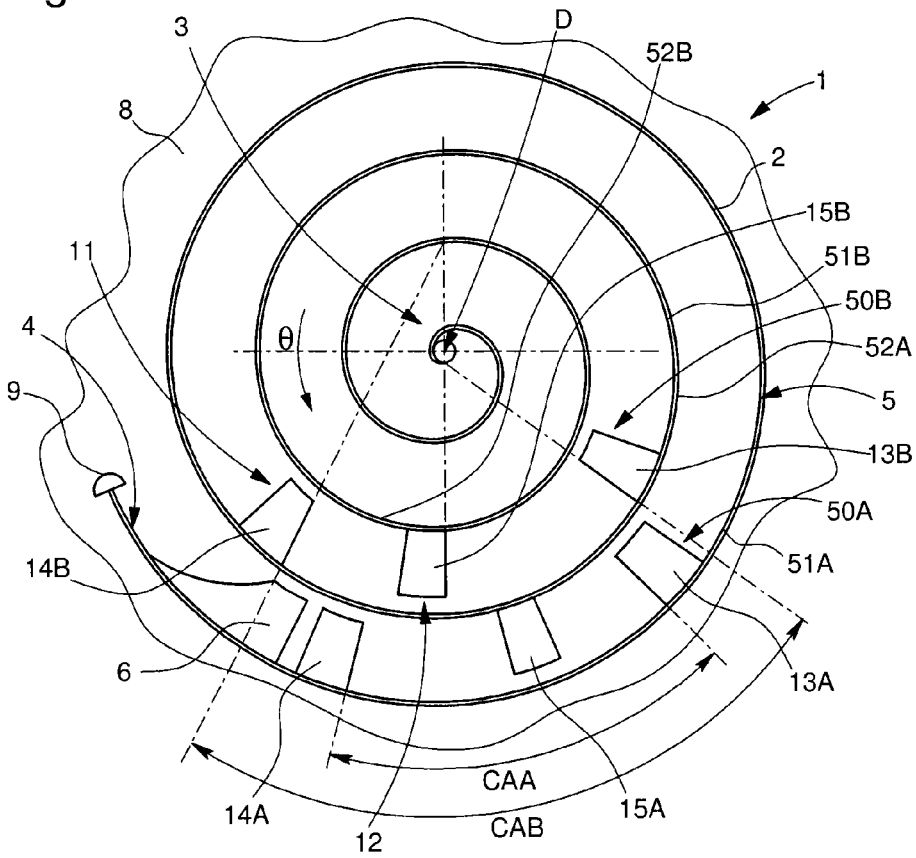
FIG. 1 shows a schematic, plan view of an anti-trip balance spring according to the invention, devised to oscillate about a pivot axis, and pinned up via the outer end thereof to a balance spring stud, and via the bottom end thereof to a collet secured to a balance; said balance spring include stop members quincuncial staggered over adjacent coils, which interfere with each other in the event of a shock or excessive amplitude, two sets of adjacent coils are arranged in this manner, but with different limitation angles between a first, more internal set, where the angle is greatest, and a second more external set, where the angle is smaller.

The invention concerns the field of timepiece mechanisms, and more specifically watch regulating members.

It is an object of the invention to improve the safety of any oscillating mechanism or energy storage mechanism, comprising a balance spring, in particular a sprung balance mechanism.

The underlying principle consists in changing the resulting rigidity of the spring when an incident occurs, in conditions of use which differ from normal operation, and particularly in the event of strong accelerations or a shock.

Modifying the rigidity of the balance spring may have other applications, and this specification, which concerns a preferred application of this invention to the anti-trip system of an escape mechanism, is in no way restrictive.

It is an object of the present invention, applied to a sprung balance, to limit the angle of rotation of the balance in the mechanism watches to a given angle, in particular for amplitudes greater than 360°. The angular travel limit is achieved in both directions of rotation without modifying the inertia of the balance. The sprung balance is said to be "free" during its normal angular travel (with respect to the anti-trip system) due to the fact that said system does not cause any shocks during the normal movement of the sprung balance.

The principle of the proposed system relies on a temporary modification of the balance spring geometry. During the extension or contraction of the balance spring due to rotation of the balance, a relative angular and radial motion occurs between the coils. Limit stop members, formed of two stop members, and a travel lock arm, are placed on two consecutive coils of the balance spring. For a maximum given angle of rotation, the stop members are placed on the coils so as to limit the relative angular travel between two coils. When the stop member, according to the direction of rotation, locks the travel of the lock arm, the balance spring loses an active coil thereby modifying its rigidity. This stop system thus relies on the relative angular motion between two coils.

The distance between the stop members and the lock arms may be non-symmetrical.

The system according to the invention thus limits the number of active coils, according to the angle of rotation, and according to the motion of the balance spring coils. The rigidity of the balance spring, according to the angle of rotation, may thus be temporarily modified as a result of the addition of this stop member system to at least one pair of coils and at most to all of the coils. Rigidity according to the amplitude of rotation may thus be defined by the distribution and number of stop member systems distributed over the balance spring. The invention endeavours to gradually limit the angle of rotation by gradual modifying the resulting rigidity of the balance spring.

According to the invention several pairs of coils are fitted in this manner. The balance spring includes stop members distributed in a quincuncial staggered arrangement on adjacent coils, which interfere with each other in the event of shocks or excessive amplitude, at least two pairs of adjacent coils are arranged in this manner, but with different limitation angles between a first, more internal set, where the angle is greater, and a second, more external set, where the angle is smaller.

In an advantageous but non-limiting embodiment, it is ensured that the centre of gravity of the balance spring is balanced. The geometry, distribution, position and number of stop members require a detailed design and this document merely summarizes the principle.

The manufacture of this type of balance spring relies on micro-manufacturing methods allowing a large degree of planar design freedom. It is possible to make this type of balance spring using silicon technology. The present invention is not limited to this technology, "LIGA" methods and other micro-manufacturing methods currently used for timepiece components, and in particular escape mechanisms, may be used.

Thus, the invention concerns, in particular, a timepiece anti-trip balance spring 1 comprising at least one strand 2 wound between a first end 3 and a second end 4. This balance spring 1 includes at least two pairs of coils 50. Each pair 50 is formed of a first coil 51 and a second coil 52 immediately adjacent to each other and respectively comprising an stopping means 11 and complementary stopping means 12 quincuncial staggered with respect to each other.

It is clear that, for each of pairs 50, the stopping means 11 and complementary stopping means 12 together define a respective, particular, maximum angular travel CA.

Stopping means 11 and complementary stopping means 12 together define, for the pair 50 to which they pertain, a maximum angular travel CA during the local coupling of first coil 51 and second coil 52. This local coupling results from stopping means 11 cooperating in abutment with complementary stopping means 12 during accelerations in the contraction or the extension of balance spring 1 which are greater than desired values, or excessive amplitude during the rotation of balance spring 1, in order to limit the number of active coils of balance spring 1.

According to the invention, in at least two of these pairs of coils 50, the respective stopping means 11 and complementary stopping means 12 are arranged so as to define different maximum angular travel values CA, in order to gradually limit the amplitude of pivoting between first end 3 and second end 4 of balance spring 1 during angular or radial accelerations of balance spring 1 greater than said desired values, so as to cause said stopping means 11 and complementary stopping means 12 of one of pairs 50 to cooperate in abutment before those of the other pair, and thus to gradually modify the resulting rigidity of balance spring 1 by successively deactivating or reactivating some of coils 5.

Figure 2:
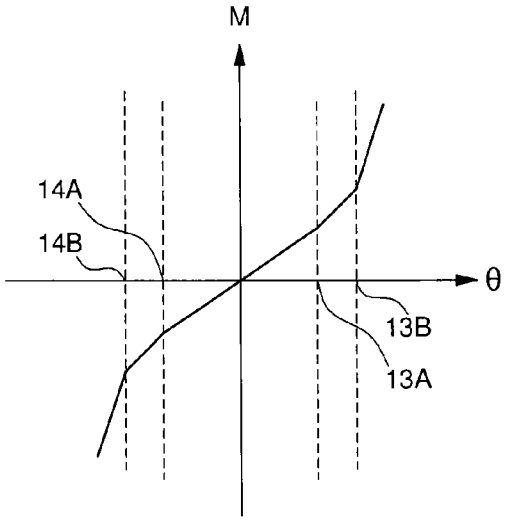
FIG. 2 shows a diagram showing torque according to the angle of rotation of the balance spring.

The curve of FIG. 2 shows the variation in torque according to the angle of rotation. Breaks can be seen in the slope at each point corresponding to a stop and coupling configuration, as explained hereinafter.

Figure 3:
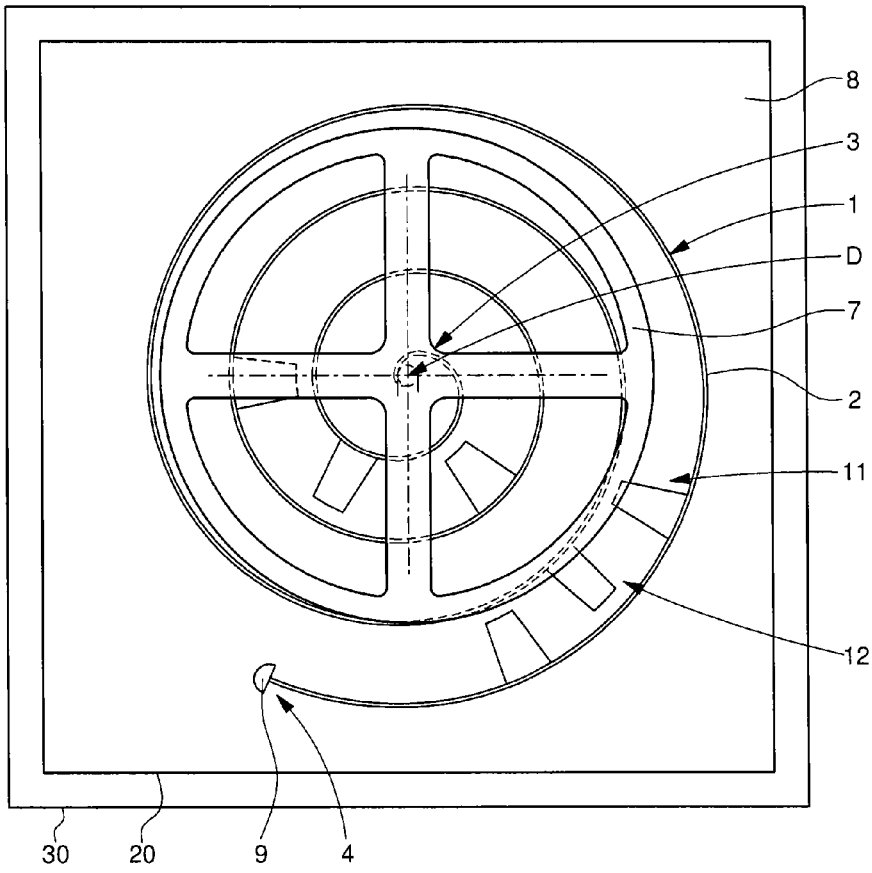
FIG. 3 shows a block diagram of a timepiece, in particular a watch, comprising a movement which includes a sprung balance comprising a balance spring according to the invention.

In the preferred and non-limiting variant, illustrated in FIGS. 1 and 3, in each pair 50, the stopping means 11 located on one of the two coils of the pair 50, comprise two limit stop members 13, 14, whose trajectory interferes with at least one complementary limit stop member 15, located on the other of the two coils of the same pair 50, comprised in complementary stopping means 12. The interference at the end stop positions defines an interval limiting the angular travel CA of the first coil 51 with respect to second coil 52. This limit allows the number of active coils of balance spring 1 to be temporarily limited, when said at least one complementary limit stop member 15 is abutting on one of these two limit stop members 13, 14.

In a particular variant, seen in FIG. 1, in addition to the limit stop members arranged on two opposing coils of the same pair 50, one coil, for example the first coil 51, or respectively the second coil 52, comprises at least one radial stop member 6 limiting the radial movement of first coil 51 with respect to second coil 52. This particular coupling is based on the relative radial motion between the coils. It is, however, restricted to the contraction of the balance spring and thus to a single direction of rotation of the balance.

In this same particular variant, advantageously at least one radial stop member 6 includes a friction surface 61, which is arranged to cooperate with a complementary friction surface 62 comprised in second coil 52 or respectively first coil 51.

In yet another variant which combines the limit stop members of pair 50 and radial stop member 6, it is stopping means 11 or complementary stopping means 12 which include this at least one radial stop member 6.

The invention also includes a timepiece sprung balance 10 comprising at least one balance spring 1 of this type, and comprising a balance 7 which pivots about an axis D and to which first end 3 or second end 4 of balance spring 1 is secured. Preferably, the amplitude of pivoting of this balance 7 is less than 360°.

The invention also concerns a timepiece movement 20 comprising a sprung balance 10 of this type and a plate 8 carrying a balance spring stud 9 for pinning up one of the ends 3, 4 of balance spring 1.

The invention also concerns a timepiece 30 incorporating at least one such movement 20, and/or at least one such sprung balance 10.

The system has the advantage of limiting the travel of the balance in both directions of rotation. This limit is achieved by modifying the rigidity of the balance spring. This modification of rigidity may be adapted via the choice of the number and distribution of the stop surfaces incorporated in the balance spring.

The inertia of the sprung balance system is only modified by the modification of the inertia of the balance spring. The anti-trip system does not disturb the normal oscillations of the sprung balance; it only affects the operation thereof when the amplitude of rotation is exceeded.

What is claimed is:

1. An anti-trip balance spring for a timepiece comprising at least one strand wound between a first end and a second end and comprising at least two pairs of coils each formed of a first coil and a second coil immediately adjacent to each other, respectively comprising an stopping means and a complementary stopping means, wherein, in at least two of said pairs of coils, said respective stopping means and complementary stopping means are arranged so as to define different maximum angular travel values, in order to gradually limit the amplitude of pivoting between said first end and said second end of said balance spring during angular or radial accelerations of said balance spring which are greater than desired values, so as to cause said stopping means and said complementary stopping means of one of said pairs to cooperate in abutment before those of said other pair, and thus to gradually modify the resulting rigidity of said balance spring by successively deactivating or reactivating some of the coils thereof.

2. The timepiece balance spring according to claim 1, wherein, in each said pair, said stopping means includes two limit stop members whose trajectory interferes with at least one complementary limit stop member comprised in said complementary stopping means to define an interval limiting said angular travel of said first coil with respect to said second coil, in order to limit the number of active coils of said balance spring when said at least one complementary limit stop member is abutting on one of said two limit stop members.

3. The timepiece balance spring according to claim 2, wherein said first coil or respectively said second coil includes at least one radial stop member limiting the radial motion of said first coil with respect to said second coil.

4. The timepiece balance spring according to claim 3, wherein said at least one radial stop member comprises a friction surface arranged to cooperate with a complementary friction surface comprised in said second coil or respectively said first coil.

5. The timepiece balance spring according to claim 3, wherein said stopping means or said complementary stopping means include said at least one radial stop member.

6. The timepiece sprung balance comprising at least one balance spring according to claim 1, and comprising a balance which pivots about an axis and to which said first or second end of said balance spring is pinned up, wherein the amplitude of pivoting of said balance is less than 360°.

7. The timepiece movement comprising a said sprung balance according to claim 6 and a plate carrying a balance spring stud for pinning up one of the ends of said balance spring.

8. The timepiece including at least one movement according to claim 7, and/or at least one sprung balance.

* * * * *